United States Patent [19]

Cordes

[11] 4,060,019

[45] Nov. 29, 1977

[54] ADJUSTABLE DRUM

[76] Inventor: Charles P. Cordes, 27 Kenneth Place, Clark, N.J. 07066

[21] Appl. No.: 715,587

[22] Filed: Aug. 18, 1976

[51] Int. Cl.[2] ..... G10D 13/02

[52] U.S. Cl. ..... 84/411 R; 84/415

[58] Field of Search ..... 84/411, 411 A, 412, 84/415–417, 420

[56] References Cited

U.S. PATENT DOCUMENTS

| | | | |
|---|---|---|---|
| 1,420,233 | 6/1922 | Baldwin et al. | 84/411 R |
| 1,456,242 | 5/1923 | Leedy | 84/411 R |
| 2,563,346 | 8/1951 | Livingston | 84/412 |

*Primary Examiner*—Lawrence R. Franklin
*Attorney, Agent, or Firm*—Sughrue, Rothwell, Mion, Zinn and Macpeak

[57] ABSTRACT

The adjustable drum is comprised of two cylindrical shells which are telescopically arranged for axial adjustment with respect to each other. At least one of the shells is constructed of metal and a separate set of casings for each drum head are provided on each shell. A plurality of spaced apart insulating strips are disposed between the shells which can be adjusted in a stepwise manner relative to each other. Special adapter plate is provided on one of the shells for supporting a conventional snare strainer mechanism.

4 Claims, 7 Drawing Figures

FIG. 5
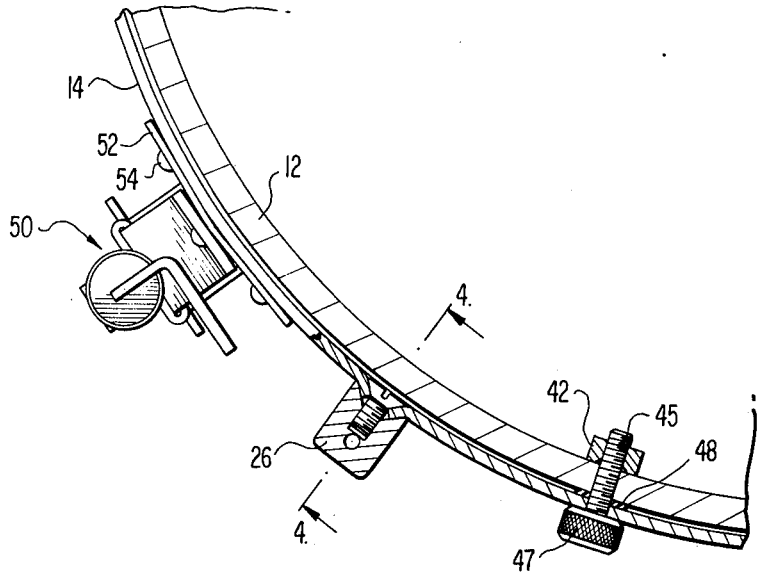
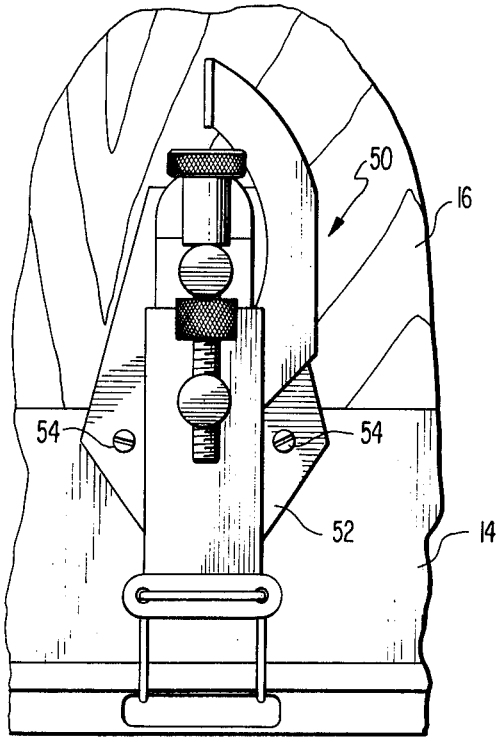
FIG. 6
FIG. 7
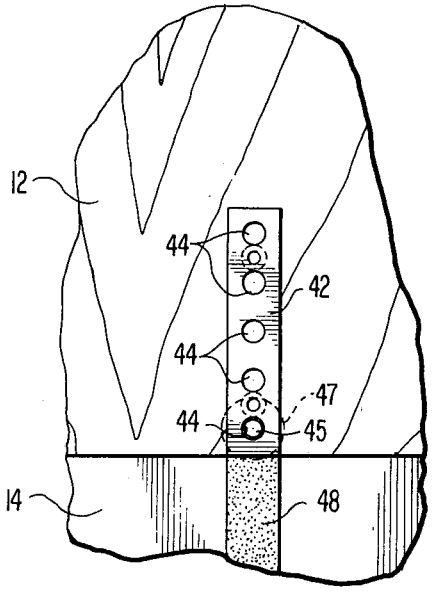

ADJUSTABLE DRUM

BACKGROUND OF THE INVENTION

1. Field of the Invention

The present invention is directed to a novel drum construction and more specifically to a drum construction having telescopically adjustable shells to obtain different sound characteristics from a single drum.

2. Prior Art

It is old and well known in the art to construct drums in such a manner that the distance between the upper and lower heads of the drum can be varied. However, the majority of these adjustable drums only have two positions, one a fully extended position for normal playing and a completely collapsed position which is only suitable for travel and not for playing.

It is also known in the art to pivot the two drum heads with respect to each other so that they can be moved from a normal parallel relationship into a non-parallel position wherein the volume of the drum is considerably larger. However, the sound characteristics obtainable with such a drum construction have proven to be unsatisfactory.

SUMMARY OF THE INVENTION

The present invention provides an adjustable drum having a telescopic two-piece shell construction which can be adjusted in a stepwise manner to cover the full range of existing snare drum sizes now in general use.

The present invention provides an improved adjustable drum having a top head or playing surface secured to the longer of two telescopically arranged shells thereby projecting maximum tonal vibrations of the drum head.

The present invention provides an improved adjustable drum construction wherein minimum contact is provided between the telescopically adjustable shells thereby improving the vibrating characteristics of the drum without undue dampening of vibrations. The spacing between the telescopic shells as well as the provision of adjusting holes which are progressively exposed as the overall shell size in increased permits the proper air release proportional to the shell depth to improve the tonal characteristics of the drum.

The present invention provides an improved adjustable drum construction having two telescopically disposed cylindrical shells, one of which is of metal construction, provided with means for achieving a stepwise elongation of the depth of the drum. The adjusting means is comprised of a plurality of equally spaced apart screw members extending through the wall of the metal shell and a plurality of axially spaced apart threaded aperture means disposed in alignment with each of said screw members. A plurality of insulating strips of plastic material are secured to the inside of the metal shell in alignment with each screw member to insulate the two shells from each other without dampening the vibrations of either shell. A plurality of casings are provided in equally spaced apart aligned relation on the top and bottom shells for securing the top and bottom heads to the respective shells. A snare strainer mechanism is mounted solely on the lower metal shell by an adapting plate which will not interfere with the adjustability of the drum.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 5 is a top plan view of a portion of the drum showing the snare strainer mechanism, with portions of the top and bottom shells being sectioned.

FIG. 6 is a side elevation view of the snare strainer mechanism as mounted on the lower shell of the drum according to the present invention.

FIG. 7 is an inside elevational view of the adjusting means between the top and bottom shells.

DETAILED DESCRIPTION OF THE PREFERRED EMBODIMENTS

The drum 10 according to the present invention is comprised of a top shell 12 and a bottom shell 14 which are telescopically disposed relative to each other. The bottom shell 14 is made of metal such as relatively thin gauge steel or the like and the top shell 12 which is disposed within the bottom shell 14 is preferably made of wood. However, it is possible to have the top and bottom shells of the same material whether it be plastic, wood or metal or any combinations thereof.

Figure 1:
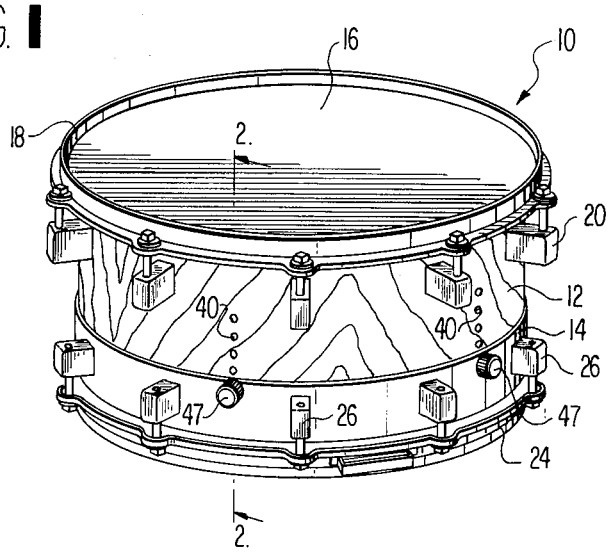
FIG. 1 is a perspective view of the adjustable drum according to the present invention in the fully extended condition.
Figure 4:
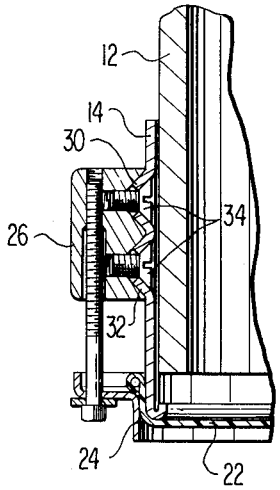
FIG. 4 is a partial sectional view taken along a line similar to 4—4 in FIG. 5 but with the drum in the collapsed condition as shown in FIG. 3.

A top head 16 is secured over one end of the cylindrical shell 12 by means of a rim 18 which is secured to the shell 12 by means of a plurality of casings 20 secured about the circumference of the outside of the shell 12 in equally spaced relation. Likewise, the bottom head 22 is secured to one end of the cylindrical shell 14 by means of a rim 24 which in turn is secured to the shell by means of a plurality of equally spaced apart casings 26. The casings 20 and 26 operate substantially identical to conventional casings but are smaller in size and a complete set is located on the top shell as well as on the bottom shell to accommodate the adjustability of the shells relative to each other. The casings 26 secured to the lower shell 14 are preferably provided with countersunk screw holes 30 and 32 so that the screws 34 which secure the casings to the shell can be countersunk flush with the interior surface of the shell 14. This arrangement, as shown in FIG. 4, enables the top shell 12 to fit within the bottom shell 14 with relatively close tolerances and without interference from the screws 34.

Figure 2:
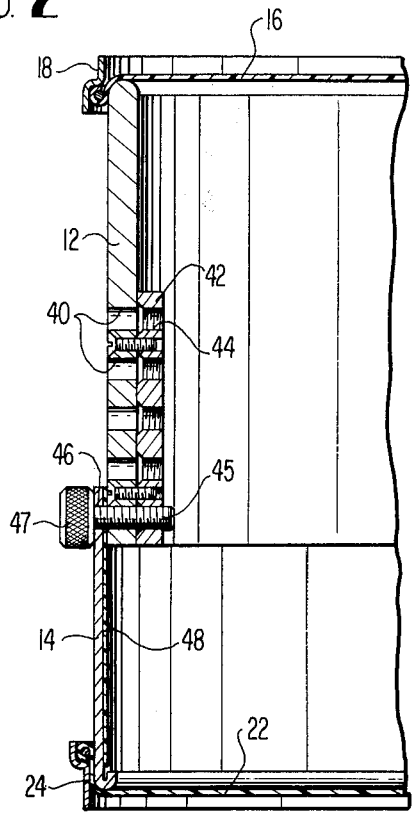
FIG. 2 is a sectional view taken along the line 2—2 of FIG. 1 showing the drum in the fully extended condition.
Figure 3:
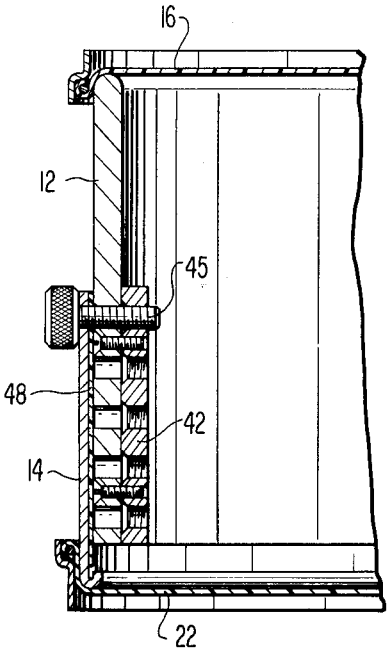
FIG. 3 is a view similar to FIG. 2 showing the drum in the fully collapsed position.

In order to provide the stepwise adjustability of the shells 12 and 14 relative to each other the top shell 12 is provided with four equally spaced rows of apertures with each row extending parallel to the axis of the cylindrical shells and contain five apertures 40. The number of apertures can vary depending upon the overall range of adjustability desired. However, by utilizing the five apertures as illustrated in FIGS. 2 and 3, the centers of which are spaced one-half inch from each other it is possible to obtain a depth range for the overall shell from five inches as shown in FIG. 3 to seven inches as shown in FIG. 2 which is satisfactory. A reinforcing adjust bar 42 having five apertures 44 spaced identical to the spacing of the apertures 40 in the casing 12 is secured to the inside of the shell 12 so that the holes 40 and 44 are in alignment with each other. The apertures 44 in the reinforcing adjust bar are threaded for the reception of an adjusting screw 45 which is threaded in an aperture 46 in the lower casing 14. The screw 45 is provided with an enlarged knurled head 47 for easy manipultion. There are four screws 45 spaced equally about the circumference of the lower shell 14 for cooperation with each of the four rows of holes 40. It is obvious that the number of rows of holes 40 and screws 45 can vary but four equally spaced adjusting means has proven to be satisfactory for a fourteen inch diameter snare drum. Four thin strips of plastic 48 are secured on the inner surface of the lower shell 14 in alignment with the adjust bars 42 so that the top and bottom shells will be insulated from each other at the four points of adjustment. The provision of these insulating strips 48 does not in any way dampen the vibrations of either the top or bottom shells and sufficient circumferential gaps are provided between the insulating strips 48 to provide for the release of air from the interior of the drum. This release of air from the interior of the drum through the gaps between the shells provides improved tonal characteristics. Likewise, the apertures 40 and 44 which are disposed above the lower shell 14 provide for an additional release of air which increases in proportion to the increase in volume of the drum to further improve the tonal characteristics of the drum.

The adjustable snare drum according to the present invention is also provided with a snare strainer mechanism which is generally indicated at 50 in FIGS. 5 and 6. The snare strainer mechanism per se is conventional and the details of construction and operation need not be set forth in the present application. However, due to the fact that the shell of the present drum is comprised of two telescopic shells 14 and 12 provision must be made for mounting the conventional strainer mechanism 50 so that it does not interfere with the adjustability of the shells. In order to accomplish this a special strainer support plate 52 is provided which is secured solely to the lower metal shell 14 by means of screws 54. The plate 52 extends up above the upper edge of the lower shell 14 to provide the proper support for the snare strainer mechanism 50. The snares are secured at one end to the adjustable mechanism 50 and at the opposite end to a conventional retainer (not shown) which is secured to the lower shell 14 diammetrically opposite the plate 52.

While the invention has been particularly shown and described with reference to a preferred embodiment thereof it will be understood by those in the art that various changes in form and details may be made therein without departing from the spirit and scope of the invention.

What is claimed is:

1. An adjustable drum comprising first and second cylindrical shells telescopically disposed relative to each other, each shell having a drum head, means for adjustably securing said drum head to each shell, a plurality of equally spaced apart adjusting means for providing stepwise adjustment between said shells and insulating means associated with each of said adjusting means for insulating said shells from each other while providing a plurality of circumferential gaps between said telescopically disposed shells.

2. An adjustable drum as set forth in claim 1 wherein the lower shell is the outermost shell and is made of metal and said adjusting means is comprised of a plurality of rows of apertures in said upper shell extending parallel to the axis of the cylindrical shells and screw means threaded through the lower shell for selective cooperation with said apertures to vary the spacing between said drum heads.

3. An adjustable drum as set forth in claim 1 wherein said insulating means is comprised of a plurality of plastic strips secured to the inner surface of the lower shell adjacent said adjusting means.

4. An adjustable drum as set forth in claim 1 further comprising a snare strainer mechanism and means for securing said snare strainer mechanism solely to the lower shell.

* * * * *